US006017863A

United States Patent [19]

Cala et al.

[11] Patent Number: 6,017,863

[45] **Date of Patent: *Jan. 25, 2000**

[54] AQUEOUS CLEANING SOLUTION AND METHOD FOR REMOVING UNCURED ADHESIVE RESIDUES

[75] Inventors: Frank Cala, Highland Park; Alfredo Vinci, Trenton, both of N.J.

[73] Assignee: Church & Dwight Co., Inc., Princeton, N.J.

[ * ] Notice: This patent is subject to a terminal disclaimer.

[21] Appl. No.: 09/083,183

[22] Filed: May 22, 1998

[51] Int. Cl.[7] ..... C11D 3/28; C11D 3/33; C11D 1/825

[52] U.S. Cl. ..... 510/200; 510/175; 510/202; 510/203; 510/206; 510/212; 510/243; 510/245; 510/365; 510/490; 510/500

[58] Field of Search ..... 510/175, 200, 510/202, 203, 206, 212, 243, 245, 365, 490, 500

[56] References Cited

U.S. PATENT DOCUMENTS

| | | |
|---|---|---|
| 4,575,569 | 3/1986 | Edwards . |
| 4,931,205 | 6/1990 | Edwards et al. . |
| 5,234,505 | 8/1993 | Winston et al. . |
| 5,234,506 | 8/1993 | Winston et al. . |
| 5,261,967 | 11/1993 | Winston et al. . |
| 5,264,047 | 11/1993 | Winston et al. . |
| 5,393,448 | 2/1995 | Winston et al. . |
| 5,397,495 | 3/1995 | Winston et al. . |
| 5,431,847 | 7/1995 | Winston et al. . |
| 5,433,885 | 7/1995 | Winston et al. . |
| 5,464,553 | 11/1995 | Winston et al. . |
| 5,593,504 | 1/1997 | Cala et al. . |
| 5,688,753 | 11/1997 | Cala et al. . |
| 5,789,363 | 8/1998 | Cala et al. ..... 510/245 |

*Primary Examiner*—Yogendra Gupta
*Assistant Examiner*—Charles Boyer
*Attorney, Agent, or Firm*—Irving M. Fishman

[57] ABSTRACT

An alkaline, aqueous cleaning solution which is capable of removing at least a substantial portion of uncured adhesive residues, e.g., epoxy-based adhesives, from a substrate, preferably a metal stencil substrate, contains water, an alkalinity-providing agent and a synergistic combination of surfactants, specifically an N-alkylpyrrolidone surfactant, which is preferably N-octyl-2-pyrrolidone, and an aminocarboxylic acid surfactant, which is preferably N-coco-beta-aminopropionic acid. At an active-concentration ratio of the N-alkyl-2-pyrrolidone surfactant to the aminocarboxylic acid surfactant of from about 1:1 to about 3.5:1 and a total active concentration of at least 0.30% by weight of the aqueous cleaning solution, the N-alkyl-2-pyrrolidone and aminocarboxylic acid surfactants synergistically improve the ability of the solution to remove uncured adhesive residues from the substrate, even at relatively low wash temperatures, e.g., from about 70° F. to less than about 135° F.

34 Claims, No Drawings

AQUEOUS CLEANING SOLUTION AND METHOD FOR REMOVING UNCURED ADHESIVE RESIDUES

BACKGROUND OF THE INVENTION

This invention is related to an aqueous cleaning solution and method of using same to remove residues from substrates. More particularly, this invention is related to an aqueous cleaning solution and method of using same to remove uncured adhesive residues from metal substrates, preferably stencils.

Adhesives are commonly used in the electronics industry to secure surface-mounted components (e.g., resistors, capacitors, inductors, transistors, integrated circuits, chip carriers and the like) to printed circuit boards prior to soldering. Stencils, which are made of metal (typically stainless steel, brass or copper), are often used to apply the adhesive to specific areas on a printed circuit board. After the adhesive has been applied to the printed circuit board, surface-mounted components are accurately placed on the precisely stenciled spots of adhesive, and the adhesive is then cured (e.g., via heat cure).

It is important to remove excess adhesive from the surface of a stencil in order to prevent the adhesive from building up and/or smearing on the stencil. Not keeping a stencil free of adhesive can cause problems, such as, e.g., the placement of an improper amount of adhesive on the circuit board or the placement of adhesive in areas where adhesive should not be. Such problems can result in product failures or in finished assemblies which are visually unacceptable.

One cleaner which has been widely used to clean stencils is isopropyl alcohol. Unfortunately, there are both environmental and safety problems associated with the use of isopropyl alcohol as a cleaning agent. For example, isopropyl alcohol is a volatile organic compound (VOC) and a dangerous fire risk.

Other cleaning systems which have been used in cleaning stencils also have problems. For example, in addition to VOC and flammability concerns, other organic solvent and semi-aqueous cleaning systems have high biological oxygen demand (BOD) and chemical oxygen demand (COD). Many aqueous systems have high pHs in addition to VOCs and relatively high BODs and CODs. In addition, many stencil-cleaning agents of all types emit unpleasant odors which can bring about worker discomfort, e.g., headaches.

To overcome the aforementioned problems, improved aqueous-based cleaning compositions for cleaning metal surfaces have been developed which are safe for workers and the environment.

For example, commonly assigned U.S. Pat. No. 5,593,504 discloses an aqueous-based cleaning composition for cleaning solder paste from surfaces, e.g., stencils, wherein the composition contains alkaline salts and a surfactant formulation composed of at least three nonionic surfactants which have cloud points that are staggered to give optimum cleaning over a broadened temperature range. Among the surfactants mentioned in the patent as being useful in the invention therein is N-(n-alkyl)-2-pyrrolidone. The composition is used at a wash temperature of from 90° F. to 145° F.

Commonly assigned U.S. Pat. No. 5,688,753 discloses an aqueous-based cleaning composition for removing flux residues, as well as residues of photoresists, solder masks, adhesives, machine oils, greases, silicones, lanolin, mold release, polyglycols and plasticizers, from electronic circuit assemblies. The composition contains one or more alkaline salts, an alkali metal silicate, and a surfactant mixture which includes, inter lia, an N-alkyl pyrrolidone.

Other aqueous-based cleaning compositions which are useful for removing residual contaminants such as rosin flux, photoresist, solder masks, adhesives, machine oils, greases, silicones, lanolin, mold release, polyglycols and plasticizers, from metal substrates are disclosed, e.g., in commonly assigned U.S. Pat. Nos. 5,234,505; 5,261,967; 5,464,553; 5,433,885; 5,393,448; 5,234,506; 5,264,047; 5,431,847; and 5,397,495. The compositions disclosed in these patents contain at least one alkaline salt and preferably further contain a corrosion inhibitor, an antifoam agent, a hydrotrope, and one or more surfactants. One of the surfactants disclosed in U.S. Pat. No. 5,431,847 is N-alkyl-2-pyrrolidone. The aforementioned patents teach that the wash temperature used therein can range from room temperature to about 180° F. In the examples set forth in these patents, the wash temperature used was typically about 160° F.–165° F.

Copending, commonly assigned U.S. application Ser. No. 08/852,065 (filed May 6, 1997), now U.S. Pat. No. 5,789,363 discloses an aqueous-based cleaning composition for removing industrial-type soils (e.g., dirt, grease, oil, ink and the like) from metal parts. The composition contains water, an alkalinity-providing agent, and a surfactant mixture composed of N-octyl-2-pyrrolidone and an aminocarboxylic acid surfactant, e.g., N-coco-β-amino propionic acid. The composition can be used at a wash temperature of from about 90° F. to about 180° F., with a temperature of from about 120° F. to about 160° F. being preferred.

Although the aqueous-based cleaning compositions disclosed in the aforementioned commonly assigned patents and copending, commonly assigned application are highly effective in removing solder and oily residues from metal surfaces, they are somewhat less effective in removing uncured adhesive residues from substrates, particularly metal substrates, more particularly from stencils.

Removing uncured adhesive residues from stencils is extremely difficult for most cleaning agents. Removal of such residues is particularly difficult for aqueous-based cleaning compositions because of the organic nature of the residues. Another factor which makes removal of uncured adhesive residues from stencils particularly difficult is that only moderate wash temperatures can be used in cleaning stencils because the materials which hold the stencil in place cannot withstand temperatures above about 135° F. Thus, unlike methods for removing oil from metal surfaces wherein relatively high temperatures (i.e., 150° F. to 180° F.) are generally required for acceptable soil removal, methods for cleaning stencils are usually restricted to temperatures of less than 135° F. Therefore, an aqueous cleaning composition capable of effectively removing oily-type soils may be less effective at removing uncured adhesive residues, particularly at relatively low wash temperatures in the case of stencil substrates.

Accordingly, a primary object of this invention is to provide an aqueous cleaning composition which has improved ability to remove uncured adhesive residues from substrates.

Another object of this invention is to provide an aqueous cleaning composition which has improved ability to remove uncured adhesive residues from metal substrates.

A further object of this invention is to provide an aqueous cleaning composition which has improved ability to remove uncured adhesive residues from stencils.

Yet another object of this invention is to provide an aqueous cleaning composition which has improved ability to remove uncured adhesive residues at relatively low wash temperatures, e.g., less than about 135° F.

A still further object of this invention is to provide a method of removing uncured adhesive residues from a substrate using an aqueous cleaning composition having the properties set forth in the preceding objects.

These and other objects which are achieved according to the present invention can be discerned from the following description.

SUMMARY OF THE INVENTION

The present invention is based on the surprising discovery that, if used in combination at a particular active-concentration ratio and at a particular total active concentration, an N-alkyl-2-pyrrolidone surfactant and an aminocarboxylic acid surfactant of formula (I) hereinbelow will, when used in combination with a commercially available alkaline cleaner (e.g., an alkaline stencil cleaner), will provide an alkaline, aqueous cleaning solution with a synergistically improved ability to remove uncured adhesive residues from substrates, e.g., metal stencils. Such synergism will occur even at relatively low wash temperatures, e.g., from about 70° F. (room temperature) to less than about 135° F.

Thus, one aspect of the present invention is directed to an alkaline, aqueous cleaning solution capable of removing at least a substantial portion of uncured adhesive residues, e.g., epoxy-based adhesives, from substrates, e.g., metal substrates, preferably stencils, at a wash temperature of less than about 135° F. The aqueous cleaning solution of this invention contains:

(A) water, (B) an alkalinity-providing agent in an amount sufficient to provide the aqueous cleaning solution with an alkaline pH, (C) an active concentration of an N-alkyl-2-pyrrolidone surfactant, and (D) an active concentration of an aminocarboxylic acid surfactant having the formula:

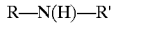

$$R—N(H)—R' \quad (I)$$

wherein R is a straight- or branched-chain aliphatic organic group having from 10 to 20 carbon atoms, and R' is a straight- or branched-chain carboxylic acid having from 2 to 10 carbon atoms;

where in the ratio of the active concentration of the N-alkyl-2-pyrrolidone surfactant to the active concentration of the aminocarboxylic acid surfactant is from about 1:1 to about 3.5:1;

further wherein the sum of the active concentration of the N-alkyl-2-pyrrolidone surfactant and the active concentration of the aminocarboxylic acid surfactant constitutes from about 0.30% to about 1.5% by weight of the aqueous cleaning solution.

In the most preferred embodiments of this invention, the N-alkyl-2-pyrrolidone surfactant is N-octyl-2-pyrrolidone and the aminocarboxylic acid surfactant is N-coco-beta-aminopropionic acid. The ratio of the active concentration of the N-alkyl-2-pyrrolidone surfactant to the active concentration of the aminocarboxylic acid surfactant is preferably from about 1:1 to about 3.5:1, more preferably from about 1:1 to about 2.75:1, most preferably about 2.5:1. The total active concentration of the N-alkyl-2-pyrrolidone and aminocarboxylic acid surfactants in the aqueous cleaning solution is preferably from about 0.35% to about 1.5%, more preferably from about 0.50% to about 1.0%, by weight of the aqueous cleaning solution.

The aqueous cleaning solution preferably has a pH of from about 10.0 to about 12.5, more preferably from about 11.0 to about 11.5.

In one preferred embodiment thereof, the aqueous cleaning solution of this invention further contains at least one nonionic surfactant, more preferably at least three nonionic surfactants having cloud points of at least 95° F. in the aqueous solution and which are at least 5° F. different from one another. Particularly preferred are three nonionic surfactants which include a first surfactant having a cloud point in the aqueous solution of from about 95° F. to about 120° F., a second surfactant having a cloud point in the aqueous solution of from about 110° F. to about 135° F., and a third surfactant having a cloud point in the aqueous solution of from about 125° F. to about 150° F., wherein the second and third surfactants have cloud points which are at least about 10° F. higher than the cloud points of the first and second surfactants, respectively.

Another aspect of this invention is directed to a method of removing at least a substantial portion of uncured adhesive residues from a substrate contaminated with such residues, involving the steps of:

(1) providing the aqueous cleaning solution of this invention; and (2) contacting the contaminated substrate with the aqueous cleaning solution for a period of time sufficient to remove at least a substantial portion of the uncured adhesive residues from the substrate.

The wash temperature used in the method of this invention is preferably from about 70° F. to less than about 135° F., more preferably from about 90° F. to about 130° F., and most preferably from about 100° F. to about 120° F.

Although unique combinations of N-alkyl-2-pyrrolidone and aminocarboxylic acid surfactants have been found to perform synergistically in the removal of oily-type soils from metal surfaces, as described in the above-mentioned copending, commonly assigned U.S. application Ser. No. 08/852,065, filed May 6, 1997, it is surprising that a combination of these surfactants could also provide synergistic removal of uncured adhesive residues from metal substrates, particularly stencils. Used individually, the N-alkyl-2-pyrrolidone and aminocarboxylic acid surfactants do not greatly increase the removal of uncured adhesive residues over that obtained with an otherwise identical aqueous cleaning solution which does not contain the surfactant. Even if used in combination, these two surfactants will not greatly increase the amount of uncured adhesive residues removed from a substrate if such surfactants are not used at both a particular active-concentration ratio and a particular total active concentration in the solution. It is only when certain active-concentration ratios and certain total active concentrations of these two surfactants are both present in the aqueous cleaning solution that a synergistic increase occurs in the amount of uncured adhesive residues removed from a substrate.

Also surprising is that the aqueous cleaning solution of this invention achieves superior cleaning of the uncured adhesive residues at relatively low wash temperatures (i.e., from about 70° F. (room temperature) to less than about 135° F.). As mentioned previously, this is important particularly in the case of stencil-cleaning because unlike the situation with removing oily-type soils from metal substrates where higher temperatures (e.g., from 150° F. to 180° F.) are generally required for acceptable soil removal, stencil-cleaning is usually restricted to temperatures of less than about 135° F.

DETAILED DESCRIPTION OF THE INVENTION

This invention provides an aqueous cleaning solution capable of removing at least a substantial portion of uncured adhesive residues from substrates contaminated with such residues, particularly metal substrates, most particularly, stencils. The present invention further provides a method of using the aforementioned solution to remove such residues from substrates.

As used herein, the term "at least a substantial portion" with respect to the amount of residues removed from the contaminated substrate generally refers to an amount of at least about 55%, preferably at least about 85%, more preferably from about 95% to about 100% by weight of the uncured adhesive residues present on the substrate before cleaning.

The uncured adhesive residues removed in the present invention can be adhesives used in the electronics industries to secure components to printed circuit board assemblies. One particularly used adhesive which can be readily removed by the solution and method of this invention is an epoxy-based adhesive available from Alpha Metals Co. under the designation "Alpha Epibond 7275". Examples of other adhesives used in the electronics industry which can be removed by the solution and method of this invention are commercially available from Heraeus Co. and Loctite Co.

As mentioned hereinabove, the particular surfactant combination of the N-alkyl-2-pyrrolidone and the aminocarboxylic acid of formula (I) at the active-concentration ratio and total active concentration values disclosed herein synergistically improves the ability of the aqueous solution to remove uncured adhesive residues from substrates, particularly metal substrates. Most particularly, the aqueous cleaning solution of this invention displays a synergistic ability to remove uncured adhesive residues from stencils which have been used to apply adhesive to a printed circuit board so that a surface-mounted component may be secured to the board by means of the adhesive.

If the active concentrations of the two surfactants relative to one another are either too high or too low, the aqueous cleaning solution will not exhibit synergism but will instead exhibit reduced cleaning performance relative to the removal of uncured adhesive residues from substrates. Therefore, the particular active-concentration ratio of the N-alkyl-2-pyrrolidone and aminocarboxylic acid surfactants is an important factor in the synergism exhibited by the surfactant combination used in the present invention.

Another important factor in obtaining synergistic results with the N-alkyl-2-pyrrolidone and aminocarboxylic acid surfactants used in the present invention is the total active concentration of the two surfactants in the aqueous cleaning solution. If the combined active concentration of the two surfactants in the aqueous solution is too low, the solution will not exhibit synergistic removal of the uncured adhesive residues. There does not appear to be a maximum limit to the total active concentration of the two surfactants which can be used in order to obtain synergistic cleaning results.

The present invention is based on the discovery that, in an alkaline aqueous cleaning solution, if (i) the active concentration of the N-alkyl-2-pyrrolidone surfactant relative to the active concentration of the aminocarboxylic acid surfactant is in the range of from about 1:1 to about 3.5:1 and (ii) the total active concentration of the N-alkyl-2-pyrrolidone and aminocarboxylic acid surfactants is from about 0.30% to about 1.5% by weight of the aqueous cleaning solution, the solution will exhibit synergism relative to the removal of uncured adhesive residues from substrates. It is to be understood that both factors (i) and (ii) must be present in order for such synergism to occur. If one of these factors is present but the other factor is not present, synergism will not occur. It is further to be understood that, along with the aforementioned surfactant combination, the aqueous cleaning solution must also contain at least one alkaline salt in order for the cleaning solution to provide synergistic removal of uncured adhesive residues.

The aqueous cleaning solution with which the surfactant combination is combined is preferably that aqueous cleaning solution disclosed in commonly assigned U.S. Pat. No. 5,593,504, which is hereby incorporated by reference herein in its entirety.

The aqueous cleaning solution of this invention is moderately alkaline and has a pH which is preferably from about 10.0 to about 12.5, more preferably from about 11.0 to about 11.5. Because the pH thereof is moderately alkaline, the aqueous cleaning solution of this invention is substantially less harmful to use and handle than highly alkaline aqueous cleaners such as those formed from sodium hydroxide or aqueous alkanol amine solutions. In addition, a moderately alkaline pH level allows the aqueous cleaning solution of this invention to effectively remove uncured adhesive residues from a substrate without burning or irritating human skin or corroding metal substrates.

The aqueous cleaning solution of this invention is composed of an aqueous portion and an active-ingredient portion. Component (A), i.e., water, constitutes the aqueous portion, while components (B)–(D) and any adjuvants present in the solution constitute the active-ingredient portion.

Component (A) of the aqueous cleaning solution of this invention is water, preferably water which has been deionized, distilled or purified by reverse osmosis treatment and the like. Although the aqueous portion of the solution of this invention may further contain one or more organic solvents, such as, e.g., hydrocarbon, halohydrocarbon, and oxygenated hydrocarbon solvents, preferred embodiments of the aqueous cleaning solution of this invention are free of organic solvents.

Component (B) of the aqueous cleaning solution of this invention is an alkalinity-providing agent, which can be one or more alkaline salts. Suitable alkaline salts or mixtures thereof are those capable of providing the desired pH. Most suitable are the salts of potassium and sodium. Especially preferred are the potassium and sodium carbonates and bicarbonates, which are safe, economical and environmentally friendly. The carbonate salts include, e.g., potassium carbonate, potassium carbonate dihydrate, potassium carbonate trihydrate, sodium carbonate, sodium carbonate decahydrate, sodium carbonate monohydrate, sodium sesquicarbonate and the double salts and mixtures thereof. The bicarbonate salts include potassium bicarbonate and sodium bicarbonate and mixtures thereof. Mixtures of the carbonate and bicarbonate salts are also especially useful.

Although not preferred, other suitable alkaline salts which can be used as the alkalinity-providing agent include the alkali metal ortho or complex phosphates. The complex phosphates are especially effective because of their ability to chelate water hardness and heavy metal ions. The complex phosphates include, for example, sodium or potassium pyrophosphate, tripolyphosphate and hexametaphosphates.

Additional suitable alkaline salts useful as the alkalinity-providing agent include the alkali metal borates, acetates, citrates, tartrates, succinates, silicates, phosphonates, edates, etc.

In particularly preferred embodiments of the present invention, the alkalinity-providing agent is a mixture of potassium carbonate and potassium bicarbonate or a mixture of potassium carbonate and sodium carbonate.

The alkalinity-providing agent is present in the aqueous cleaning solution of this invention in an amount sufficient to provide the solution with a moderately alkaline pH, preferably a pH of from about 10.0 to about 12.5, more preferably from about 11.0 to about 11.5.

The amount of the alkalinity-providing agent in the aqueous cleaning solution of this invention is preferably from about 0.1% to about 1.5% by weight, more preferably from about 0.5% to about 1.0% by weight, of the solution. The alkalinity-providing agent preferably constitutes from about 30% to about 60% by weight of the active-ingredient portion of the solution of this invention.

Component (C) of the aqueous cleaning solution of this invention is an N-alkyl-2-pyrrolidone surfactant. N-alkyl-2-pyrrolidones suitable for use in the present invention are described in U.S. Pat. No. 5,093,031, which is hereby incorporated by reference herein. Preferably, the alkyl group in the N-alkyl-2-pyrrolidone surfactant contains from about 6 to about 15 carbon atoms. The most preferred N-alkyl-2-pyrrolidone surfactant for use in the solution of this invention is N-octyl-2-pyrrolidone. A suitable N-octyl-2-pyrrolidone surfactant for use in the present invention is commercially available under the designation "ISP Surfadone LP-100" from International Specialty Products.

Component (D) of the aqueous cleaning solution of this invention is an aminocarboxylic acid surfactant having the formula:

$$R—N(H)—R' \quad (I)$$

wherein R is a straight- or branched-chain aliphatic organic group having from 10 to 20 carbon atoms, and R' is a straight- or branched-chain carboxylic acid having from 2 to 10 carbon atoms.

In formula (I) above, R preferably has from 12 to 18 carbon atoms and R' preferably has from 2 to 4 carbon atoms. More preferably, R' is a 1-carboxy-2-yl group. The most preferred aminocarboxylic acid surfactant for use in the present invention is N-coco-beta-aminopropionic acid surfactant. Particularly suitable N-coco-beta-aminopropionic surfactants for use in this invention are commercially available from Henkel Corporation under the designation "Deriphat 151-C" and from Akzo Nobel Chemicals, Inc. under the designation "Akzo Armoteric C".

As stated previously herein, if used in combination at a certain active-concentration ratio and at a certain total active concentration in the solution of this invention, the N-alkyl-2-pyrrolidone surfactant and the aminocarboxylic acid surfactant will synergistically improve the solution's ability to remove uncured adhesive residues from substrates, even at relatively low wash temperatures (e.g., from about 70° F. to less than about 135° F.). Such synergism has been found to occur when (i) the ratio of the active concentration of the N-alkyl-2-pyrrolidone surfactant to the active concentration of the aminocarboxylic acid surfactant is from 1:1 to 3.5:1, more preferably from about 1:1 to about 2.75:1, most preferably about 2.5:1, and (ii) the total active concentration of the N-alkyl-2-pyrrolidone and aminocarboxylic acid surfactants in the aqueous cleaning solution is at least 0.30%, preferably from about 0.35% to about 1.5%, more preferably from about 0.50% to about 1.0%, by weight of the solution.

If the active-concentration ratio is too high or too low and/or the total active concentration is too low, the desired high level of adhesive residue removal will not be attained.

As used herein with respect to the amounts of the N-alkyl-2-pyrrolidone and aminocarboxylic acid surfactants, the term "active concentration" refers to the concentration of the active form of the surfactants. For example, the N-octyl-2-pyrrolidone surfactant is typically provided as a 100% active surfactant formulation. Thus, the active concentration of such N-octyl-2-pyrrolidone surfactant in a solution will be equal to the amount of such surfactant added to the solution. On the other hand, an N-coco-beta-aminopropionic acid surfactant is generally provided as a 40% active surfactant formulation. Thus, the active concentration of such N-coco-beta-aminopropionic acid surfactant in a solution will generally be equal to 40% of the amount of such surfactant added to the solution.

The solution of this invention may further contain one or more additives conventionally used in aqueous cleaning solutions. Examples of such additives are disclosed in U.S. Pat. No. 5,593,504, which was earlier incorporated by reference herein.

For example, the solution of this invention may contain additional surfactants in addition to those of components (C) and (D). Suitable examples of such surfactants are set forth in the aforementioned U.S. Pat. No. 5,593,504. In addition to components (C) and (D) herein, the cleaning solution of the present invention preferably also includes (E) at least one additional surfactant component, which is preferably a nonionic surfactant to improve cleaning efficacy. More preferably, a plurality of additional surfactants are used and which are provided in a surfactant formulation which contains at least three nonionic surfactants having differing cloud points to be highly effective for cleaning over a broad temperature range. In general, the nonionic surfactants will have cloud points at least 5° F. different from each other. It is important to recognize that the cloud point of the additional surfactant(s) as stated herein is the cloud point of the surfactant(s) in the aqueous cleaning solution of the present invention. The cloud point of the surfactant as defined herein is the particular temperature upon heating at which there is a sudden onset of turbidity within the aqueous solution as a result of surfactant separation.

More specifically, the nonionic surfactants which may form the additional surfactant formulation (E) preferably will have cloud points ranging from about 5 to about 25° F. from each other and, more preferably, from about a 10 to 20° F. difference from the cloud points of each other. It is to be understood that additional nonionic surfactants can be included in the solution having a cloud point so as to further broaden the temperature range at which the solution is most effective. Similarly, other nonionic surfactants which have cloud points in between the cloud points of the three surfactants of the formulation can also be included although it is not believed that such surfactants particularly add to the efficacy of the cleaning solution of this invention and may simply provide undesirable additional organic materials which add to the biological oxygen demand (BOD) and chemical oxygen demand (COD) of the aqueous solution.

The nonionic surfactants which are optionally present in the solution of this invention include any nonionic surfactant which is available so long as the three surfactants utilized in the formulation have cloud points which are staggered by at least 5° F. from each other. In general, nonionic surfactants such as ethoxylated alcohols, ethylene oxide-propylene oxide block copolymers, ethoxylated-propoxylated alcohols, alcohol alkoxylate phosphate esters, ethoxylated amines and alkoxylated thioethers are believed to be useful as adjuvant surfactants in the solution of this invention.

More specific examples of nonionic surfactants include ethoxylated thiol surfactants as described for example in U.S. Pat. Nos. 4,575,569 and 4,931,205, the contents of both of which are herein incorporated by reference. A particularly useful commercial product is an ethoxylated dodecylmercaptan with about 6 ethylene oxide units which is a commercial product known as Alcodet 260™ marketed by Rhone-Poulenc.

Examples of other nonionic surfactants include compounds formed by condensing ethylene oxide with a hydrophobic base formed by the condensation of propylene oxide with propylene glycol. The hydrophobic portion of the molecule which exhibits water insolubility has a molecular weight from 1,500 to 1,800. The addition of polyoxyethylene radicals to this hydrophobic portion tends to increase the water solubility of the molecule as a whole in a liquid and the liquid character of the product is retained up to the point where the polyoxyethylene content is about 50% of the total weight of the condensation product. Examples of solutions are the "Pluronics" sold by BASF.

Other suitable surfactants as component (E) include those derived from the condensation of ethylene oxide with the product resulting from the reaction of propylene oxide and ethylene-diamine or from the product of the reaction of a fatty acid with sugar, starch or cellulose. For example, compounds containing from about 40% to 80% polyoxyethylene by weight having a molecular weight from about 5,000 to 11,000 resulting from the reaction of ethylene oxide groups with a hydrophobic base constituted of the reaction product of ethylene diamine and excess propylene oxide, and hydrophobic basis having a molecular weight of the order of 25,000 to 3,000 are satisfactory.

In addition, the condensation product of aliphatic alcohols having from 8 to 18 carbon atoms, in either straight chain or branched chain configuration, with ethylene oxide and propylene oxide may also be employed. Examples of such surfactants are those of the "Plurafac" series, also sold by BASF.

Other useful surfactants include alkoxylated alcohols which are sold under the tradename of "Polytergent SL-Series" surfactants by Olin Corporation or "Neodol" by Shell Chemical Co.

Polyoxyethylene condensates of sorbitan fatty acids, alkanol amides, such as the monoalkanolamides, dialkanolamides, and amines; and alcohol alkoxylated phosphate esters, such as the "Klearfac" series from BASF are also useful surfactants in the solutions of this invention.

The polyethylene oxide/polypropylene oxide condensates of alkylphenols can also be used, but such surfactants are not effectively biodegradable and, in most cases, should be avoided.

Preferably, the amount of the component (E) nonionic surfactant(s), if used, will constitute at least about 0.02% by weight, more preferably from about 0.04% to about 0.15% by weight of the aqueous cleaning solution of this invention.

The solution of this invention may further contain (F) one or more hydrotropes. Hydrotropes tend to keep surfactants readily dispersed in aqueous solutions. Suitable hydrotropes for use in this invention include the sodium, potassium, ammonium, and alkanol ammonium salts of xylene, toluene, ethylbenzoate, isopropylbenzene, naphthalene, alkyl naphthalene sulfonates, phosphate esters of alkoxylated alkyl phenols, phosphate esters of alkoxylated alcohols and sodium, potassium and ammonium salts of the alkyl sarcosinates.

A particularly preferred hydrotrope for use in the present invention is one that does not foam. Among the most useful of such hydrotropes are the alkali metal salts of intermediate chain length (i.e., $C_7$–$C_{13}$) monocarboxylic fatty acids. The most preferred of these hydrotropes are the alkali metal octanoates and nonanoates.

The hydrotrope is preferably used in the aqueous solution of this invention in an amount of from about 0.15% to about 0.45% by weight.

Another adjuvant which can be added to the cleaning solution of the present invention includes (G) anionic surfactants which are effective over a wide temperature range and do not cloud out as characterizes the nonionic surfactants. A particularly useful anionic surfactant is the polycarboxylated ethylene oxide condensates of fatty alcohols such as manufactured by Olin under the tradename of "Polytergent CS-1". If used, the adjuvant anionic surfactant(s) preferably constitutes from about 0.0025% to about 0.05% by weight of the aqueous cleaning solution of this invention.

A nonionic defoamer (H) can also be added advantageously to the solution of the present invention. Typically, the defoamers are equivalent to the nonionic surfactants described above and include, for example, nonionic alkoxylated alcohols including fatty alcohols. If used, the nonionic defoamer preferably constitutes from about 0.04% to about 0.1% by weight of the aqueous cleaning solution of this invention.

The aqueous cleaning solution of this invention may further contain (I) one or more corrosion inhibitors to prevent corrosion of metal substrates, e.g., stencils. A commonly used metal in stencils is brass, which can be very sensitive to alkaline solutions. Accordingly, the preferred corrosion inhibitor is an alkali metal silicate salt with the sodium and the potassium silicate salts being most preferred. The alkali metal silicates can be in a variety of forms which can be expressed generally by the formula $M_2O:SiO_2$ wherein M represents the alkali metal and which the ratio of two oxides can vary. Most useful alkali metal silicates will have an $M_2O$ to $SiO_2$ mole ratio of between 1:0.5 to 1:4.5. Most preferably, the $M_2O$ to $SiO_2$ ratio is between 1:1.6 and 1:4.0. Such silicates also provide additional alkalinity to the wash water to help clean.

If used, the corrosion inhibitor preferably constitutes from about 0.05% to about 0.5% by weight of the aqueous cleaning solution of this invention.

At low pH, i.e., below 13, and, in particular, below 12, it has been found that the silicate precipitates from aqueous solutions. Thus, the silicates need to be stabilized. The silicates can be stabilized and kept in aqueous solution by the addition of an anionic polymer to the solution. Particularly preferred are anionic polymers containing carboxylate groups.

In general, anionic homopolymers or copolymers with molecular weights between about 1,000 to about 5 million or mixtures thereof are usefully employed in this invention as silicate stabilizers (J). However, the optimal polymers are ones which dissolve easily and do not increase the viscosity of the solutions to excessive levels when added at the concentration required for optimum silicate stability.

The following anionic polymers are non-inclusive examples of those suitable for stabilizing silicates in aqueous alkaline solutions according to this invention: carboxymethyl cellulose, polyacrylic acid, polymeth-acrylic acid, polymaleic acid, polyglycolic acid, heteropolymers of acrylic and methacrylic acid, xanthan gum, carrageenan gum and alginate gum. In the alkaline solution of this invention, the anionic polymers are essentially present in the form of the sodium or potassium salts thereof. Additional alkali can be added to neutralize the polymer.

In a preferred embodiment, a high molecular weight polyacrylic acid such as in the form of sodium polyacrylate in solution is employed as the silicate stabilizing agent. The polyacrylate used in this embodiment should have a molecular weight of between about 100,000 and 4 million, preferably, 150,000 to 4 million. An especially preferred molecular weight range is about 250,000 to 2 million. Examples of such polymers are marketed under the tradename "Carbopol", from B.F. Goodrich.

The alkali metal silicate stabilizer is preferably provided in amounts of from about 0.05% to 0.15% by weight of the aqueous cleaning solution of this invention.

The aqueous cleaning solution of this invention preferably contains at least about 0.8% by weight of the active-ingredient portion, with the proviso that the total active concentration of the N-alkyl-2-pyrrolidone surfactant and the aminocarboxylic acid surfactant in the cleaning solution is at least 0.30% by weight, preferably from about 0.35% to about 1.5% by weight, more preferably from about 0.50% to about 1.0% by weight, based on the weight of the solution. More preferably, the aqueous cleaning solution of this invention contains from about 95.0% to about 99.0% by weight of the aqueous portion, i.e., component (A), and from about 1.0% to about 5.0% of the active-ingredient portion (i.e., components (B)–(D) and any adjuvants present in the solution). Most preferably, the aqueous cleaning solution of this invention contains from about 97.0% to about 98.5% by weight of the aqueous portion and from about 1.5% to about 3.0% by weight of the active-ingredient portion.

The aqueous cleaning solution of this invention can be formed from an aqueous concentrate which is then diluted with water, preferably deionized water, to form the aqueous solution. The concentrate preferably contains from about 10% to about 50% by weight of the active-ingredient portion and from about 50% to about 90% by weight of the aqueous portion. More preferably, the concentrate preferably contains from about 15% to about 30% by weight of the active-ingredient portion and from about 70% to about 85% by weight of the aqueous portion. The aqueous concentrate is preferably diluted in water at a dilution rate of 10% by volume (10X). Obviously, smaller or higher dilution rates may also be used and most likely will range from dilutions of 5X to 20X based on the dilution of the concentrate. It is to be understood, however, that the amount of surfactants (C) and (D) in the concentrate must be such that when the concentrate is diluted to form a solution, the solution will contain the requisite amount of surfactants (C) and (D), i.e., at least about 0.30%, preferably from about 0.35% to about 1.5%, more preferably from about 0.50% to about 1.0%, by weight of the solution.

The present invention is further directed to a method of removing at least a substantial portion of uncured adhesive residues from a substrate contaminated therewith. The method of this invention involves the steps of:

(1) providing the aqueous cleaning solution of this invention; and (2) contacting the contaminated substrate with the aqueous cleaning solution for a period of time sufficient to remove at least a substantial portion of the uncured adhesive residues from the substrate.

The cleaning solution may be applied to the substrate by immersion techniques, spray-in-air techniques, mechanical brushing, or by hand. It is preferred that the cleaning of stencils be accomplished using automated equipment, including equipment which operates by immersion, spray-in-air and ultrasonics.

Preferably, the contaminated substrate is contacted with the aqueous cleaning solution for a period of time sufficient to remove substantially all of the uncured adhesive residues from the substrate, i.e., to render the substrate substantially free of uncured adhesive residues. Such period of time will vary depending upon the degree of contamination but generally will range from about 1 minute to about 10 minutes, typically from 1 to 5 minutes.

The temperature of the solution during the cleaning of the substrate preferably ranges from about 70° F. (room temperature) to less than about 135° F., more preferably from about 90° F. to about 130° F., most preferably from about 100° F. to about 120° F.

The usefulness of the cleaning solution of this invention at temperatures below 135° F. is a particularly important advantage when the substrate is a stencil. Above such temperature, the stencil apparatus can be harmed as adhesives used to hold the metal stencils in place in a framing device can soften, loosening the stencil and consequently reducing the ability of the stencil to be properly aligned for printing.

Once the uncured adhesive residues have been loosened and removed from the substrate during the period of contact with the aqueous cleaning solution, the substrate is taken from the cleaning solution. The substrate may then simply be flushed with water, deionized water being preferred, for a period of up to 2 minutes. The cleaned substrate is then preferably dried, preferably with forced air. Drying is expedited if the air is warmed, preferably to a temperature between about 80° F. to about 120° F.

After contact with the substrate is complete, the cleaning solution can be filtered and recycled for reuse.

The aqueous cleaning solution of this invention may be used to clean any substrate which is contaminated with uncured adhesive residues. Preferably, the cleaning solution is used to clean metal or plastic substrates, more preferably metal substrates. Non-limiting examples of metal substrates which can be cleaned by means of the aqueous solution of this invention include, e.g., brass, stainless steel, copper, iron, iron alloys, tin, aluminum, tungsten, titanium, molybdenum, and the like. The structure of the metal substrate to be cleaned can vary widely and is unlimited. Thus, the metal substrate can be as a metal part of complex configuration, sheeting, coils, rolls, bars, rods, plates, disks, and the like. Such metal components can be derived from any source including for home use, for industrial use such as from the aerospace industry, automotive industry, electronics industry, and the like, wherein the metal surfaces have to be cleaned. Preferably, the aqueous cleaning solution of this invention is used to remove uncured adhesive residues from metal screens, metal stencils, printed circuit boards, and the like.

A non-limiting example of a plastic substrate which can be cleaned in accordance with the present invention is a Lexan® polycarbonate substrate.

Most preferably, the aqueous cleaning solution of this invention is used to remove uncured adhesive residues from stencils (which are usually made of stainless steel, brass or copper) which have been used to apply adhesive to a printed circuit board, the adhesive being used to bond a surface-mounted component to the board.

The following examples illustrate but do not limit the present invention.

Experimental

In the examples and comparative examples set forth hereinbelow, the effectiveness of various aqueous cleaning solutions in removing uncured adhesive residues from a metal substrate is measured and compared.

Comparative Examples A–E

Comparative Examples A–E illustrate the ability of an aqueous-based commercial stencil-cleaning solution which does not contain the synergistic surfactant combination used in the present invention.

In Comparative Examples A–E, five (5) pre-weighed 3-inch×1-inch stainless steel 304L coupons were each coated with a given weight of Alpha Epibond 7275 epoxy adhesive (applied with a spatula) and then weighed ("Initial Weight"). The coated coupons were allowed to dry overnight (about 18 hours) at room temperature and were then washed by being submerged for 20 minutes in a 250 ml beaker containing 200 grams of a stencil-cleaning aqueous cleaning solution having the formulation shown in Table I below. During the cleaning step, the aqueous solution was stirred at 300 rpm and had a temperature of 120° F.

In the Tables hereinbelow, the following terms have the meanings as set forth below: "Builder"—refers to sodium carbonate, potassium carbonate or a mixture thereof.

"Nonionic/Anionic Surfactant Mixture"—refers to a mixture of nonionic and anionic surfactants. This term does not refer to the synergistic surfactant combination of the N-alkyl-2-pyrrolidone and aminocarboxylic acid surfactants described herein.

"LP100"—N-octyl-2-pyrrolidone (available from International Specialty Products under the designation "ISP Surfadone LP-100")

"151C"—N-coco-β-amino propionic acid (available from Henkel Corporation under the designation "Deriphat-151-C")

TABLE I

Stencil-Cleaning Aqueous Solution: Formulation

| Ingredient | Concentration (Wt. %) |
|---|---|
| Water | 98.3 |
| Builder | 1.0 |
| Corrosion Inhibitor | 0.3 |
| Hydrotrope | 0.3 |
| Nonionic/Anionic Surfactant Mixture | 0.1 |
| pH | 11. 30 |

The washed coupons were rinsed for about 5 seconds in a separate beaker containing deionized water and then weighed ("Final Weight"). The percent of cleaning (i.e., percent removal) was calculated using the following formula:

$$\frac{(\text{Initial Weight} - \text{Final Weight})}{\text{Initial Weight}} \times 100$$

The results are presented in Table II below.

TABLE II

Comparative Examples A–E: Cleaning Results at 120° F.

| Example | Percent Removal |
|---|---|
| A | 32.22 |
| B | 15.22 |

TABLE II-continued

Comparative Examples A–E: Cleaning Results at 120° F.

| Example | Percent Removal |
|---|---|
| C | 24.84 |
| D | 25.63 |
| E | 40.38 |

The results presented in Table II show the difficulty associated with removing uncured adhesive residues from metal surfaces using a conventional stencil-cleaning aqueous solution.

EXAMPLES 1–7

Examples 1–7 show the cleaning results obtained when the N-alkyl-2-pyrrolidone and N-coco-β-amino propionate surfactants are used together in certain ratios and certain total concentrations within the scope of the present invention.

In Examples 1–7, seven (7) pre-weighed stainless steel 304L coupons were coated with Alpha Epibond 7275 epoxy adhesive (applied with a spatula) and then weighed again ("Initial Weight"). The coated coupons were allowed to dry overnight (about 18 hours) at room temperature. The coupons were then washed at a temperature of 120° F. and rinsed in the same manner as were the coupons in Comparative Examples A–E except that the aqueous cleaning solutions used in these examples have the formulations set forth in Table III below.

TABLE III

Examples 1–7: Aqueous Solution Formulations

| | Concentration (Wt. %) | | | |
|---|---|---|---|---|
| Ingredient | 1 | 2 | 3 | 4 |
| Water | 98.00 | 97.95 | 97.80 | 97.80 |
| Builder | 1.0 | 1.0 | 1.0 | 1.0 |
| Corrosion Inhibitor | 0.3 | 0.3 | 0.3 | 0.3 |
| Hydrotrope | 0.3 | 0.3 | 0.3 | 0.3 |
| Nonionic/Anionic Surfactant Mixture | 0.1 | 0.1 | 0.1 | 0.1 |
| LP100 | 0.214 | 0.25 | 0.25 | 0.36 |
| 151C | 0.086 | 0.1 | 0.25 | 0.14 |
| pH | 11.30 | 11.30 | 11.30 | 11.30 |
| | 5 | 6 | 7 | |
| Water | 97.30 | 97.80 | 97.80 | |
| Builder | 1.0 | 1.0 | 1.0 | |
| Corrosion Inhibitor | 0.3 | 0.3 | 0.3 | |
| Hydrotrope | 0.3 | 0.3 | 0.3 | |
| Nonionic/Anionic Surfactant Mixture | 0.1 | 0.1 | 0.1 | |
| LP100 | 0.714 | 0.35 | 0.375 | |
| 151C | 0.286 | 0.15 | 0.125 | |
| pH | 11.30 | 11.30 | 11.30 | |

The rinsed coupons were then weighed ("Final Weight"). The percent of cleaning was measured using the same formula set forth hereinabove. The cleaning results are presented in Table IV below.

In Table IV, the following terms have the meanings as set forth below:

"LP100/151C"—the weight ratio of the N-octyl-2-pyrrolidone and the N-coco-β-amino propionic acid surfactants "Total Conc."—the total concentration of the N-octyl-2-pyrrolidone and the N-coco-β-amino propionic acid surfactants in the cleaning solution "% Removal"—the amount of uncured adhesive residues removed from the surface

TABLE IV

Examples 1–7: Cleaning Results at 120° F.

| Example No. | LP100 % | 151C % | Total Conc. | LP100/ 151C | % Removed |
|---|---|---|---|---|---|
| 1 | 0.214 | 0.086 | 0.30 | 2.5:1 | 86.45 |
| 2 | 0.25 | 0.1 | 0.35 | 2.5:1 | 93.97 |
| 3 | 0.25 | 0.25 | 0.50 | 1:1 | 90.72 |
| 4 | 0.36 | 0.14 | 0.50 | 2.5:1 | 89.43 |
| 5 | 0.714 | 0.286 | 1.0 | 2.5:1 | 96.46 |
| 6 | 0.35 | 0.15 | 0.50 | 2.3:1 | 85.99 |
| 7 | 0.375 | 0.125 | 0.50 | 3:1 | 56.16 |

COMPARATIVE EXAMPLES

Comparative Examples F–R show the cleaning results ained when the N-alkyl-2-pyrrolidone and N-coco-β-amino propionate surfactants are used either individually or together in ratios and certain total concentrations which are outside the scope of the present invention. In Comparative Examples F–R, thirteen (13) pre-weighed stainless steel 304L coupons were coated with Alpha Epibond 7275 epoxy adhesive (applied with a spatula) and weighed again ("Initial Weight"). The coated coupons were allowed to dry overnight (about 18 hours) at room temperature. The coupons were then washed at 120° F. and rinsed in the sane manner as the coupons in comparative Examples A–E and Examples 1–7 except that the aqueous cleaning solutions used in Comparative Examples F–R had the formulations set forth in Table V below.

TABLE V

Comparative Examples F–R: Aqueous Solution Formulations

| | Concentration (Wt. %) | | | | |
|---|---|---|---|---|---|
| Ingredient | F | G | H | I | J |
| Water | 98.05 | 98.05 | 97.80 | 97.80 | 98.05 |
| Builder | 1.0 | 1.0 | 1.0 | 1.0 | 1.0 |
| Corrosion Inhibitor | 0.3 | 0.3 | 0.3 | 0.3 | 0.3 |
| Hydrotrope | 0.3 | 0.3 | 0.3 | 0.3 | 0.3 |
| Nonionic/Anionic Surfactant Mixture | 0.1 | 0.1 | 0.1 | 0.1 | 0.1 |
| LP100 | 0.25 | 0 | 0.5 | 0 | 0.125 |
| 151C | 0 | 0.25 | 0 | 0.5 | 0.125 |
| pH | 11.30 | 11.30 | 11.30 | 11.30 | 11.30 |
| | K | L | M | N | O |
| Water | 98.05 | 98.05 | 98.05 | 98.00 | 97.80 |
| Builder | 1.0 | 1.0 | 1.0 | 1.0 | 1.0 |
| Corrosion Inhibitor | 0.3 | 0.3 | 0.3 | 0.3 | 0.3 |
| Hydrotrope | 0.3 | 0.3 | 0.3 | 0.3 | 0.3 |
| Nonionic/Anionic Surfactant Mixture | 0.1 | 0.1 | 0.1 | 0.1 | 0.1 |
| LP100 | 0.18 | 0.1875 | 0.063 | 0.25 | 0.125 |
| 151C | 0.071 | 0.063 | 0.187 | 0.05 | 0.375 |
| pH | 11.30 | 11.30 | 11.30 | 11.30 | 11.30 |

TABLE V-continued

Comparative Examples F–R: Aqueous Solution Formulations

| | Concentration (Wt. %) | | | | |
|---|---|---|---|---|---|
| Ingredient | F | G | H | I | J |
| | P | Q | R | | |
| Water | 98.05 | 98.05 | 97.95 | | |
| Builder | 1.0 | 1.0 | 1.0 | | |
| Corrosion Inhibitor | 0.3 | 0.3 | 0.3 | | |
| Hydrotrope | 0.3 | 0.3 | 0.3 | | |
| Nonionic/Anionic Surfactant Mixture | 0.1 | 0.1 | 0.1 | | |
| Monatrope | 0 | 1.0 | 0 | | |
| LP100 | 0.125 | 0.25 | 0.25 | | |
| 151C | 0.125 | 0 | 0 | | |
| Active Amine* | 0 | 0 | 0.1 | | |
| pH | 11.30 | 11.30 | 11.30 | | |

*The active amine compound was an alkylamine having a molecular weight of about 204, wherein the amine was a primary amine and the alkyl group was a coco-alkyl group.

The rinsed coupons were weighed ("Final Weight"). The percent of cleaning was measured using the formula presented earlier herein. The cleaning results are presented in Table IV below.

TABLE VI

Comparative Examples F–R: Cleaning Results at 120° F.

| Example No. | LP100 % | 151C % | Total Conc. | LP100/ 151C | % Removed |
|---|---|---|---|---|---|
| F | 0.25 | 0 | 0.25 | N/A | 6.6 |
| G | 0 | 0.25 | 0.25 | N/A | 56 |
| H | 0.5 | 0 | 0.50 | N/A | wt. gain |
| I | 0 | 0.5 | 0.50 | N/A | 38 |
| J | 0.125 | 0.125 | 0.25 | 1:1 | 54.68 |
| K | 0.18 | 0.071 | 0.25 | 2.5:1 | 54.68 |
| L | 0.1875 | 0.063 | 0.25 | 3:1 | 78.02 |
| M | 0.063 | 0.187 | 0.25 | 0.34 | 73.07 |
| N | 0.25 | 0.05 | 0.30 | 5:1 | 34.16 |
| O | 0.125 | 0.375 | 0.50 | 0.33:1 | 63.39 |
| P | 0.125 | 0.125 | 0.25 | 1:1 | 32.28 |
| Q | 0.25 | 0 | 0.25 | N/A | 5.9 |
| R | 0.25 | 0 | 0.35* | N/A | weight gain |

*The total concentration shown here is the sum of the concentration of the LP-100 surfactant and the active amine.

The results shown in Tables IV and IV show that, at particular ratios and total concentration values, the combination of the LP100 surfactant and the 151C surfactant synergistically increases the ability of the cleaning composition to remove uncured adhesive residues from the stainless steel surface.

The composition in Example 1, which contained a total LP100+151C concentration of 0.30% by weight and an LP100:151C ratio of 2.5:1, removed 86.45% by weight of the uncured adhesive residues. On the other hand, the composition of Comparative Example N, which also contained a total LP100+151C concentration of 0.30% by weight but had an LP100:151C ratio of 5:1, removed only 34.16% by weight of the residues. Furthermore, the composition of Comparative Example K, which had an LP100:151C ratio of 2.5:1 but which contained a total LP100+151C concentration of 0.25% by weight, removed only 54.68% by weight of the residues. Thus, the use of the LP100 and 151C surfactants at both an LP100:151C ratio of 2.5:1 and a total LP100+151C concentration of 0.30% by weight removed significantly more residues than did the use of the same surfactants but at (i) an LP100:151C ratio of 2.5:1 and an LP100:151C concentration of 0.25% by weight, and (ii) an LP100+151C concentration of 0.30% by weight and an LP100:151C ratio of 5:1.

The compositions in Comparative Examples F and Q, each of which contain ed 0.25% by weight of the LP100 surfactant but none of the 151C surfactant, removed 6.6% and 5.9% by weight, respectively, of the uncured adhesive residues at a wash temperature of 120° F. The composition of Comparative Example G, which contained none of the LP100 surfactant but 0.10% by weight of the 151C surfactant, removed only 56% by weight of the uncured adhesive residues at 120° F. However, the composition of Example 2, which contained 0.25% by weight of the LP100 surfactant and 0.10% by weight of the 151C surfactant, removed 93.97% by weight of the uncured adhesive residues at 120° F. Thus, an aqueous-based cleaning composition containing the combination of 0.25% by weight of the LP100 surfactant and 0.10% by weight of the 151C surfactant (i.e., for an LP100/151C ratio of 2.5:1 and a total LP100+151C concentration of 0.35% by weight) removed significantly more of the uncured adhesive residues than did (i) an aqueous-based cleaning composition containing 0.25% by weight of the LP100 surfactant and no 151C surfactant or (ii) an aqueous-based cleaning composition containing 0.10% by weight of the 151C surfactant but no LP100 surfactant. Therefore, since the amount of uncured adhesive residues removed by the composition of Example 2 did not lie between the amounts removed by the Comparative F, Q and G compositions but rather was significantly more than the higher amount removed by these comparative compositions, the surfactant combination used in Example 2 synergistically improved the ability of the composition to remove the uncured adhesive residues.

The Example 3 composition, which contained a total LP100+151C surfactant concentration of 0.50% by weight and had an LP100:151C ratio of 1:1, removed 90.72% by weight of the uncured adhesive residues. The Example 4 composition, which contained a total LP100+151C surfactant concentration of 0.50% by weight and had an LP100:151C ratio of 2.5:1, removed 89.43% by weight of the uncured adhesive residues. The Example 6 composition, which contained a total LP100+151C surfactant concentration of 0.50% by weight and had an LP100:151C ratio of 2.3:1, removed 85.99% by weight of the uncured adhesive residues. On the other hand, the composition of Comparative Example O, which also contained a total LP100:151C surfactant concentration of 0.50% by weight but had an LP100:151C ratio of 0.33:1, removed only 63.39% by weight of the residues. This shows the importance of the particular LP100:151C ratio used in removing uncured adhesive residues.

As mentioned above, the Example 3 composition contained a total LP100+151C surfactant concentration of 0.50% by weight and an LP100:151C ratio of 1:1 and removed 90.72% by weight of the uncured adhesive residues. The composition of Comparative Example J also had an LP100:151C ratio of 1:1 but contained a total LP100+151C surfactant concentration of 0.25% by weight and removed only 54.68% by weight of the uncured adhesive residues. These results show the importance of the total concentration of the LP100 and 151C surfactants used to the ability of the composition to remove uncured adhesive residues.

The results presented in Table VI further show that when the surfactants are used individually (i.e., not together) in the stencil-cleaning solution, the surfactants have little effect on the adhesive removal. Even when used together, if the LP100/151C ratio is too high (e.g., Comparative Example N), the desired high level of adhesive removal is not attained.

Although the cleaning results obtained with the solution used in Example 7 was not as good as those obtained in Examples 1–6, the percent removal obtained with the Example 7 solution, which contained a total LP100+151C concentration of 0.50% and had an LP100:151C ratio of 3:1, was still higher than the highest percent removal obtained with the LP100 and 151C surfactants individually. For example, the Example 7 solution removed 56.16% by weight of the residues, while the solution of Comparative Example H (which contained 0.5% LP100 and no 151C surfactant) exhibited weight gain, and the solution of Comparative Example I (which contained 0.5% of the 151C surfactant and no LP100 surfactant) removed only about 38% by weight of the residues.

EXAMPLES 8–10 AND COMPARATIVE EXAMPLES S and T

Examples 8–10 and Comparative Examples S and T illustrate the ability of solutions within and outside the scope of the invention to remove uncured adhesive residues at a temperature of 100° F.

In Examples 8–10 and Comparative Examples S and T. the surfactants are disposed in aqueous cleaning solutions having the formulation shown in Table VII below. The aqueous solution prepared in Comparative Example T contained only water and the surfactant combination used in the present invention.

In Examples 8–10 and Comparative Examples S and T, five (5) pre-weighed stainless steel 304L coupons were coated with Alpha Epibond 7275 epoxy adhesive (applied with a spatula) and weighed ("Initial Weight"). The coated coupons were allowed to dry overnight (about 18 hours) at room temperature. The coupons were then washed at 100° F. and rinsed in the same manner as the coupons in the previous examples herein except that the aqueous cleaning solutions had the formulations shown in Table VII below.

TABLE VII

Examples 8–10 and Comparative Examples S and T: Aqueous Solution Formulations

| | Concentration (Wt. %) | | | | |
|---|---|---|---|---|---|
| Ingredient | 8 | 9 | 10 | S | T |
| Water | 97.95 | 97.80 | 97.80 | 98.30 | 97.80 |
| Builder | 1.0 | 1.0 | 1.0 | 1.0 | 1.0 |
| Corrosion Inhibitor | 0.3 | 0.3 | 0.3 | 0.3 | 0.3 |
| Hydrotrope | 0.3 | 0.3 | 0.3 | 0.3 | 0.3 |
| Nonionic/Anionic Surfactant Mixture | 0.1 | 0.1 | 0.1 | 0.1 | 0.1 |
| LP100 | 0.25 | 0.25 | 0.35 | 0 | 0.25 |
| 151C | 0.10 | 0.25 | 0.15 | 0 | 0.25 |
| pH | 11.30 | 11.30 | 11.30 | 11.30 | 11.30 |

The rinsed coupons were weighed ("Final Weight"). The percent of cleaning was calculated as in the previous examples. The cleaning results are presented in Table VIII below.

TABLE VIII

Examples 8–10 and Comparative Examples S and T: Cleaning Results at 100° F.

| Example No. | LP100 % | 151C % | Total Conc. | LP100/ 151C | % Removed |
|---|---|---|---|---|---|
| 8 | 0.25 | 0.10 | 0.35 | 2.5:1 | 94.17 |
| 9 | 0.25 | 0.25 | 0.50 | 1:1 | 86.98 |
| 10 | 0.35 | 0.15 | 0.50 | 2.3:1 | 96.72 |
| S | 0 | 0 | 0 | N/A | 27.1 |
| T | 0.25 | 0.25 | 0.50 | 1:1 | 57.22 |

The data presented in Table VIII shows that compositions within the scope of this invention (Examples 8–10) provide excellent removal of uncured adhesive residues even at temperatures as low as 100° F. Comparative Example S shows that an aqueous solution which does not contain the surfactants used in the present invention provides poor removal of uncured adhesive residues. Comparative Example T, wherein the solution contained the LP100 and 151C surfactants but in combination with water alone, shows that, even in the presence of the LP100 and 151C surfactants, the removal of uncured adhesive residues is much lower if the solution otherwise contains only water.

EXAMPLE 11 AND COMPARATIVE EXAMPLE U

Example 11 and Comparative Example U illustrate the different cleaning abilities at the relatively low wash temperature of 80° F. of a composition within the scope of this invention (Example 11) and a composition outside the scope of this invention (Comparative Example U).

The compositions used in Example 11 and Comparative Example U are set forth in Table IX below. The Example 11 composition contained the synergistic surfactant combination of the present invention. The composition used in Comparative Example 11 was identical to the composition used in Example 11 except that the comparative example composition contained no surfactants.

TABLE IX

Example 11 and Comparative Example U: Aqueous Solution Formulations

| Ingredient | Concentration (Wt. %) 11 | U |
|---|---|---|
| Water | 97.95 | 98.30 |
| Builder | 1.0 | 1.0 |
| Corrosion Inhibitor | 0.3 | 0.3 |
| Hydrotrope | 0.3 | 0.3 |
| Nonionic/Anionic Surfactant Mixture | 0.1 | 0.1 |
| LP100 | 0.25 | 0 |
| 151C | 0.10 | 0 |
| pH | 11.30 | 11.30 |

In Example 11 and Comparative Example U, two (2) pre-weighed stainless steel 304L coupons were coated with Alpha Epibond 7275 epoxy adhesive (applied with a spatula) and weighed ("Initial Weight"). The coated coupons were allowed to dry overnight (about 18 hours) at room temperature. The coupons were then washed at 80° F. and rinsed in the same manner as the coupons in the previous examples herein except that the aqueous cleaning solutions had the formulations shown in Table IX above.

The rinsed coupons were weighed ("Final Weight"). The percent of cleaning was calculated as in the previous examples. The cleaning results are presented in Table X below.

TABLE X

Example 11 and Comparative Example U: Cleaning Results at 80° F.

| Example No. | LP100 % | 151C % | Total Conc. | LP100/ 151C | % Removed |
|---|---|---|---|---|---|
| 11 | 0.25 | 0.10 | 0.35 | 2.5:1 | 84.61 |
| U | 0 | 0 | 0 | N/A | 11.37 |

The data presented in Table X shows that at the relatively low wash temperature of 80° F., a composition containing the surfactant combination of this invention provides much better removal of uncured adhesive residues from a substrate than does an otherwise identical composition which does not contain the surfactant combination. This shows the importance of using the LP100 and 151C surfactants, which removed 84.61% by weight of the uncured adhesive residues, as opposed to merely using adjuvant surfactants (i.e., those surfactants other than the LP-100 and 151C surfactants), which removed only 11.34% by weight of the residues.

In summary, the results obtained in the Examples and Comparative Examples set forth hereinabove show that the combination of the LP100 and 151C surfactants, if used at a particular ratio and concentration, will syner-gistically improve the ability of the aqueous-based cleaning solution to remove uncured adhesive residues.

What is claimed is:

1. An alkaline, aqueous cleaning solution capable of removing at least a substantial portion of uncured adhesive residues from a substrate contaminated therewith, said solution comprising:

(A) water, (B) an alkalinity-providing agent in an amount sufficient to provide the aqueous cleaning solution with an alkaline pH, and (C) an active concentration of an N-alkyl-2-pyrrolidone surfactant, and (D) an active concentration of an aminocarboxylic acid surfactant having the formula:

$$R—N(H)—R' \quad (I)$$

wherein R is a straight- or branched-chain aliphatic organic group having from 10 to 20 carbon atoms, and R' is a straight- or branched-chain carboxylic acid having from 2 to 10 carbon atoms;

wherein the ratio of the active concentration of the N-alkyl-2-pyrrolidone surfactant to the active concentration of the aminocarboxylic acid surfactant is from about 1:1 to about 3.5:1;

further wherein the sum of the active concentration of the N-alkyl-2-pyrrolidone surfactant and the active concentration of the aminocarboxylic acid surfactant constitutes at least 0.30% by weight of the aqueous cleaning solution.

2. A solution according to claim 1, wherein the active-concentration ratio of the N-alkyl-2-pyrrolidone surfactant to the aminocarboxylic acid surfactant ranges from about 1:1 to about 2.5:1.

3. A solution according to claim 1, wherein the active-concentration ratio of the N-alkyl-2-pyrrolidone surfactant to the aminocarboxylic acid surfactant is about 2.5:1.

4. A solution according to claim 1, wherein the sum of the active concentrations of the N-alkyl-2pyrrolidone surfactant and the aminocarboxylic acid surfactant constitutes from about 0.35% to about 1.5% by weight of said aqueous cleaning solution.

5. A solution according to claim 1, wherein the sum of the active concentrations of the N-alkyl-2-pyrrolidone surfactant and the aminocarboxylic acid surfactant constitutes from about 0.50% to about 1.0% by weight of said aqueous cleaning solution.

6. A solution according to claim 1, wherein the alkyl group in the N-alkyl-2-pyrrolidone surfactant comprises from about 6 to about 15 carbon atoms.

7. A solution according to claim 1, wherein the N-alkyl-2-pyrrolidone surfactant is N-octyl-2-pyrrolidone.

8. A solution according to claim 1, wherein R comprises from 12 to 18 carbon atoms, and R' comprises from 2 to 4 carbon atoms.

9. A solution according to claim 1, wherein the aminocarboxylic acid surfactant is N-coco-beta-aminopropionic acid.

10. A solution according to claim 1, wherein the N-alkyl-2-pyrrolidone surfactant is N-octyl-2-pyrrolidone and the aminocarboxylic acid surfactant is N-coco-beta-aminopropionic acid.

11. A solution according to claim 1, wherein the solution has a pH of from about 10.0 to about 12.5, further wherein the amount of the alkalinity-providing agent is such as to provide the solution with a pH of from about 10.0 to about 12.5.

12. A solution according to claim 1, wherein the alkalinity-providing agent is selected from the group consisting of alkali metal carbonates, alkali metal bicarbonates and mixtures thereof.

13. A solution according to claim 1, further comprising (E) at least one nonionic surfactant.

14. A solution according to claim 1, further comprising (E) at least three nonionic surfactants having cloud points of at least 95° F. in the aqueous solution and the cloud points are at least 5° F. different from one another.

15. A solution according to claim 14, wherein said three nonionic surfactants include a first surfactant having a cloud point in the aqueous solution of from about 95° F. to about 120° F., a second surfactant having a cloud point in said aqueous solution of from about 110° F. to about 135° F., and a third surfactant having a cloud point in the aqueous solution of from about 125° F. to about 150° F., wherein the second and third surfactants have cloud points which are at least about 10° F. higher than the cloud points of the first and second surfactants, respectively.

16. A method of removing at least a substantial portion of uncured adhesive residues from a substrate contaminated therewith, comprising the steps of:

(1) providing an alkaline, aqueous cleaning solution comprising:

(A) water, (B) an alkalinity-providing agent in an amount sufficient to provide the aqueous cleaning solution with an alkaline pH, and (C) an active concentration of an N-alkyl-2-pyrrolidone surfactant, and (D) an active concentration of an aminocarboxylic acid surfactant having the formula:

$$R—N(H)—R' \quad (I)$$

wherein R is a straight- or branched-chain aliphatic organic group having from 10 to 20 carbon atoms, and R' is a straight- or branched-chain carboxylic acid having from 2 to 10 carbon atoms;

wherein the sum of the active concentration of the N-alkyl-2-pyrrolidone surfactant and the active concentration of the aminocarboxylic acid surfactant constitutes at least 0.30% by weight of the aqueous cleaning solution; and (2) contacting said contaminated substrate with said aqueous cleaning solution for a period of time sufficient to remove at least a substantial portion of said uncured adhesive residues from said substrate.

17. A method according to claim 16, wherein in step (2) said aqueous cleaning solution has a temperature of from about 70° F. to less than about 135° F. during contact of said solution with said substrate.

18. A method according to claim 16, wherein in step (2) said aqueous cleaning solution has a temperature of from about 90° F. to about 130° F. during contact of said solution with said substrate.

19. A method according to claim 16, wherein in step (2) said aqueous cleaning solution has a temperature of from about 100° F. to about 120° F. during contact of said solution with said substrate.

20. A method according to claim 16, wherein said uncured adhesive residues comprise epoxy-based residues.

21. A method according to claim 16, wherein said substrate comprises a metal.

22. A method according to claim 21, wherein said metal is selected from the group consisting of brass, stainless steel and copper.

23. A method according to claim 21, wherein said substrate is a stencil.

24. A method according to claim 23, wherein said stencil has been used to apply adhesive to a printed circuit board, the adhesive being used to secure a surface-mounted component to said board, further wherein said uncured adhesive residues disposed on said stencil are residues of said adhesive.

25. A method according to claim 16, wherein the active-concentration ratio of the N-alkyl-2-pyrrolidone surfactant to the aminocarboxylic acid surfactant in the aqueous cleaning solution ranges from about 1:1 to about 3.5:1.

26. A method according to claim 16, wherein the active-concentration ratio of the N-alkyl-2-pyrrolidone surfactant to the aminocarboxylic acid surfactant in the aqueous cleaning solution ranges from about 1:1 to about 2.5:1.

27. A method according to claim 16, wherein the sum of the active concentrations of the N-alkyl-2-pyrrolidone surfactant and the aminocarboxylic acid surfactant in the aqueous cleaning solution constitutes from about 0.35% to about 1.5% by weight of said solution.

28. A method according to claim 16, wherein the N-alkyl-2-pyrrolidone surfactant in the aqueous cleaning solution is N-octyl-2-pyrrolidone.

29. A method according to claim 16, wherein the aminocarboxylic acid surfactant in the aqueous cleaning solution is N-coco-beta-aminopropionic acid.

30. A method according to claim 16, wherein in the aqueous cleaning solution the N-alkyl-2-pyrrolidone surfactant is N-octyl-2-pyrrolidone and the aminocarboxylic acid surfactant is N-coco-beta-aminopropionic acid.

31. A method according to claim 16, wherein the aqueous cleaning solution further comprises (E) at least one nonionic surfactant.

32. A method according to claim 16, wherein the aqueous cleaning solution further comprises (E) at least three nonionic surfactants having cloud points of at least 95° F. in the aqueous solution and the cloud points are at least 5° F. different from one another.

33. A method according to claim 30, wherein said three nonionic surfactants include a first surfactant having a cloud point in the aqueous solution of from about 95° F. to about 120° F., a second surfactant having a cloud point in said aqueous solution of from about 110° F. to about 135° F., and a third surfactant having a cloud point in the aqueous solution of from about 125° F. to about 150° F., wherein the second and third surfactants have cloud points which are at least about 10° F. higher than the cloud points of the first and second surfactants, respectively.

34. A method according to claim 16, wherein the aqueous cleaning solution has a pH of from about 10.0 to about 12.5.

* * * * *